United States Patent [19]

Berzenye

[11] 4,171,840

[45] Oct. 23, 1979

[54] PROTECTIVE COATED WIRE ROPE SLING AND METHOD FOR MAKING SAME

[76] Inventor: Michael L. Berzenye, 15147 Rayneta Dr., Sherman Oaks, Calif. 91403

[21] Appl. No.: 871,214

[22] Filed: Jan. 23, 1978

[51] Int. Cl.[2] ..... A44B 31/00

[52] U.S. Cl. ..... 294/74

[58] Field of Search ..... 294/74, 75, 76, 77; 87/7, 8; 124/90; 267/69, 73; 224/49; 264/274, 275, 219

[56] References Cited

U.S. PATENT DOCUMENTS

| | | | |
|---|---|---|---|
| 3,394,455 | 7/1968 | Grimmer | 264/274 |
| 3,512,223 | 5/1970 | Willinger | 294/74 |
| 3,718,945 | 3/1973 | de Troglede | 294/74 |

*Primary Examiner*—James B. Marbert

*Attorney, Agent, or Firm*—Huebner & Worrel

[57] ABSTRACT

A wire rope sling having a coating for protecting material lifted thereby, and having eyes at both ends for engaging a crane hook. The coating is a flexible, abrasion resisting plastic, such as urethane, positioned on a substantial part of the sling intermediate the eyes. The coating is fixed to the wire rope and thick enough to withstand the maximum load of the wire rope.

The method of applying a plastic coating to a wire rope sling including hanging the wire rope vertically, placing a tube over a portion of the sling to be coated, closing the lower end of the tube with a cylindrical block having a bore therethrough to receive the wire rope and having a conical recess at its upper end to form a taper at the lower end of the coating on the wire rope, securing the tube and block on the wire rope, filling the tube from its upper end with the liquid plastic coating, inserting two semicylindrical blocks into the upper end of the tube, said upper blocks having diametrical contacting faces and a central bore formed in said faces to fit around the rope adjacent the upper end of the tube. The upper blocks having flanges around their upper ends to fit over the tube, and together at their lower ends form a downwardly opening conical recess to form a taper at the upper end of the coating. The plastic coating is embedded into outer rope surfaces and cured by heating.

18 Claims, 5 Drawing Figures

FIG. 4.
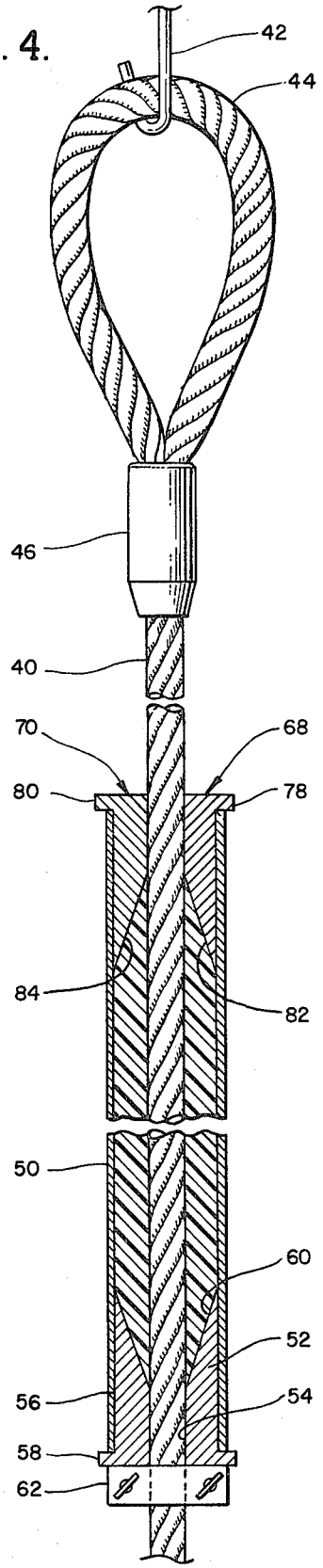
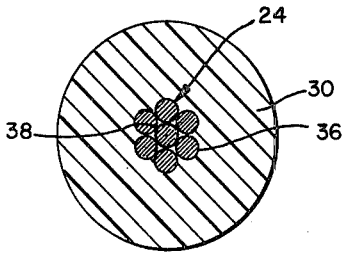
FIG. 3.
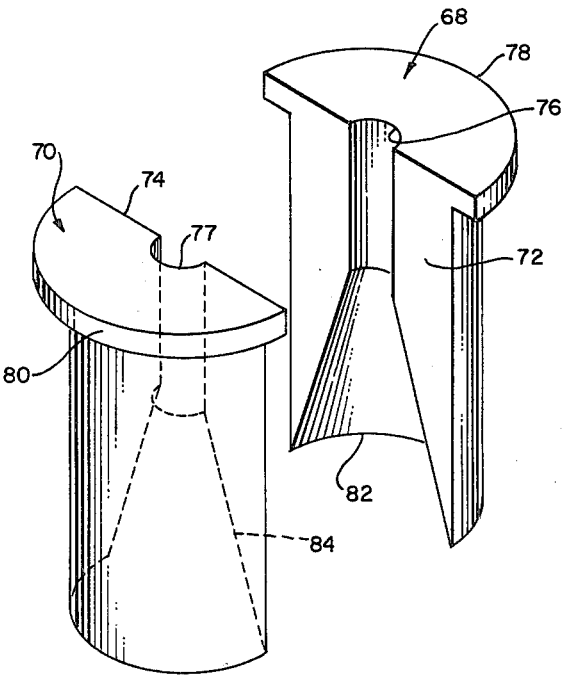
FIG. 5.

PROTECTIVE COATED WIRE ROPE SLING AND METHOD FOR MAKING SAME

BACKGROUND OF THE INVENTION

Prior art slings used in stevedoring operations have had protective coverings, such as canvas fire hoses, but they have been unsuccessful in that they become loose and slip to expose the material being lifted directly to the wire rope which cuts into the material. These wire rope slings are used, for example, to lift large rolls of low carbon steel rods or wire. The damage caused by bare wire rope slings or hose covered slings has resulted in very substantial claims being filed and paid by insurance companies. The protective coating on the present invention has eliminated the claims for damages, and has saved thousands of dollars in damage claims during a short period of use.

SUMMARY OF THE INVENTION

The present invention is a wire rope sling having a high abrasion resistant plastic, such as urethane, over the portion of the sling that comes into contact with the material being lifted. The wire rope is coated with the plastic by a method which causes the plastic to be embedded in and around the surfaces of the wires so that it is permanently fixed on the sling and does not slide or break off.

The slings are typically made from six-stranded improved plow steel having 19 wires per strand, and an independent wire rope core. The slings are made in 10, 15 and 20 ft. lengths from 7/16", ½" and ⅝" diameter wire rope. It has been discovered that the proper amount of coating increases the diameter of the coated portion to about 1½" or about three times the diameter of these rope sizes. The covered portions are 10 or 12 ft. in length, depending upon the length of the sling.

It has also been found that the urethane used should have a Shore hardness of about 95 or 95 A. This coating has sufficient flexibility to bend at least 90° when carrying a maximum load for the wire rope. Other coatings that may be used are nylon, polyvinyl chloride, and teflon, for example.

When the slings, according to the invention, are slipped through large rolls of low carbon steel rods, the lower portions of the slings form 90° angles with the roll ends. When the slings extend vertically upwardly from the rolls during the lifting, the rated capacity for a 7/16" wire rope is 6800 pounds, for a ½" wire rope is 8800 pounds and for a ⅝" wire rope is 13,600 pounds. When the sling ends form a 60° angle at the crane hook, the load capacity for a 7/16" wire rope is 5800 pounds, for a ½" wire rope is 7600 pounds, and for a ⅝" wire rope is 11,800 pounds. When the sling ends at the crane hook form a 90° angle, the capacity for a 7/16" wire rope is 4800 pounds, for a ½" wire rope is 6200 pounds, and for a ⅝" wire rope is 9600 pounds.

Accordingly, it is an object of the invention to provide an improved wire rope sling and method for making the same.

It is another object of the invention to provide a plastic coated sling and method in which the plastic shrinks onto the wire rope and embeds itself in the surface areas thereof so that its adherence to the wire rope is greatly increased.

It is still another object of the invention to provide a method for applying the coating to the wire rope by a very inexpensive method in contrast to the expense that would be required by the manufacturing of injection molds.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 3 is an enlarged cross-sectional view of the sling shown in FIG. 2, taken along the line 3—3;

FIG. 4 is an elevational, cross-sectional view illustrating apparatus for employing the method to make the invention; and FIG. 5 is an exploded view of a pair of blocks used in the upper end of the tube, shown in FIG. 4.

DESCRIPTION OF THE PREFERRED EMBODIMENTS

Figure 1:
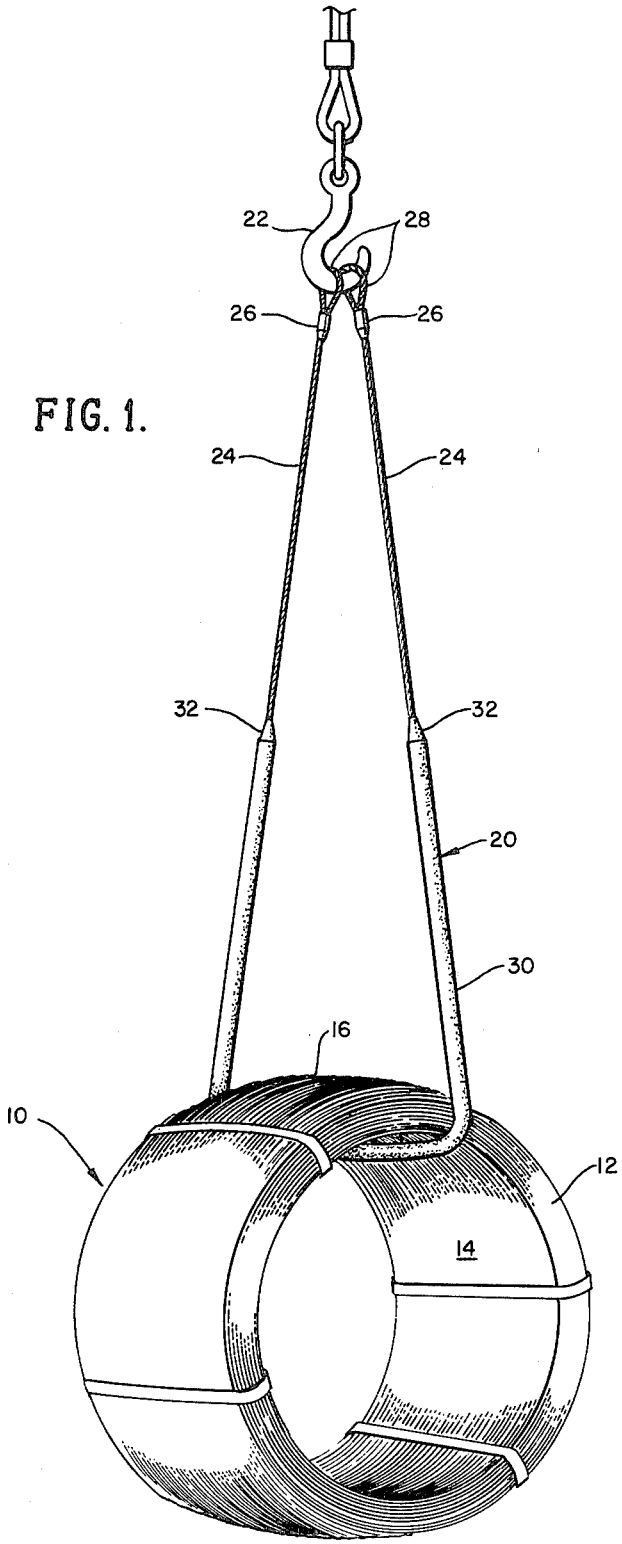
FIG. 1 is an elevational view of a sling according to the invention having eyes attached to a crane hook for lifting a large roll of low carbon steel rods.

Referring again to the drawings, there is shown in FIG. 1 a large roll 10 of low carbon steel rods as are typically removed from the hold of a ship and placed on a pier by means of a crane. The roll forms approximate right angles at its sides 12 with the inner circumference 14, the sides extending almost vertically to the outer circumference 16. Engaged to lift the roll 10 is a sling, generally designated as 20. The sling has been slipped through the central opening of the roll and is in engagement with the upper inner circumference thereof and on both sides 12, from which it extends upwardly where it is engaged with a crane hook 22.

The sling is comprised of a wire rope 24 and adjacent its ends has swaged sleeves 26 which are employed to form the wire rope eyes 28 at the ends. Intermediate the eyes and on a portion of the wire rope is a material protective coating 30. The coating 30 extends over a sufficient portion of the sling so that all contact with the material lifted will be made directly by the coating and not by the bare wire rope. The coating is generally cylindrical and has tapered ends 32 so that the sling is easily slipped onto the material and between rows of rolls to be lifted separately, for example.

Figure 2:
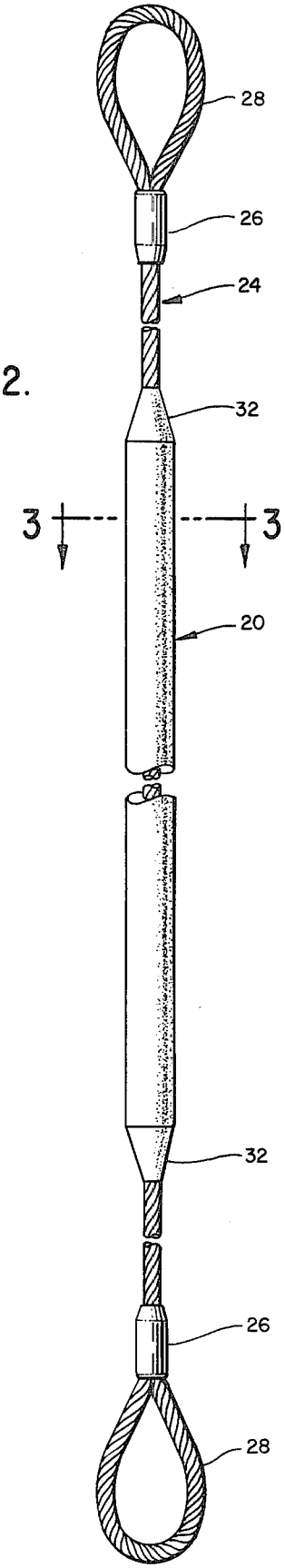
FIG. 2 is an elevational view of a sling according to the invention.

In FIGS. 2 and 3 the wire rope 20 is shown in detail. For purposes of illustration, slings of the type shown are formed of six strands 36 of improved plow steel having nineteen (19) wires per strand, and having an independent wire rope core 38. As indicated above, the wire rope typically varies in size for the particular slings between 7/16" and ⅝" diameter and the coating 30 made from a plastic, such as urethane, has a diameter of about 1½" or about three times the diameter of these sizes of wire rope it covers. The tapered ends 32 are about 1½" long. The urethane is made to have a hardness of about 95 A and is flexible enough so as to permit the slings to be bent at least 90°. To permanently fix the urethane in place on the wire rope during the molding process, it is embedded into the surface wires and strands of the wire rope 24.

It has been found in the particular structure shown that the plastic coating 20 will outlast the wire rope in the eyes 28 so that the limited use of the particular rope depends for the most part on the wear of the eyes. As shown in FIG. 1, sling 20 is positioned so that only the coating 30 makes contact with the roll during the lifting thereof. By such use of the sling, there is no damage to a roll such as shown in FIG. 1.

In FIGS. 4 and 5 the method of making the slings 20 is illustrated. A degreased bare wire rope 40 is generally hung from an overhead position on a hook 42, for example, which may be engaged with an eye 44 made by the use of a swaged sleeve 46. In this manner the rope is hung vertically.

For a wire rope of the size described, a 1½" ID, 1¾" OD tube 50 is slipped over the portion of the rope which is to be coated. According to the length of the sling to be made, the tube may be 9 to 15 ft. in length, for example, and may be made of aluminum, for lightness.

After the tube is slipped onto the rope, a generally cylindrical block 52 is inserted into the lower end of the tube. The block has a central bore 54 which is adapted to fit snugly over the lower end of the wire rope within the tube, the outer cylindrical surface 56 of the block fitting snugly within the tube to prevent leakage of the liquid to be applied. At the lower end of the block is an annular flange 58 on which the lower end of the tube rests. At the upper end of the block is a conical recess 60 which is adapted to form the taper on the lower end of the coating. The tube and block are supported by the rope by a clamp 62 attached thereto below the block, the block having its lower end in abutment with the clamp. The clamp is typically secured in place by a pair of wing nuts. Extending below the clamp 62 is a portion of the wire rope which is to be made into a second eye to complete the sling.

After the clamp 62 is engaged so that the wire rope supports the tube and the lower block 52, the rope is centrally positioned within the lower end of the tube. The tube 50 being lightweight is held sufficiently erect by the flange 58 and the block bore on the wire rope to have a liquid plastic, such as urethane, poured into its upper end.

The plastic, such as urethane, is heated to be liquified and is mixed with a conventional hardening material to achieve the discovered Shore hardness of about 95 A that has been found to be the proper hardness and which will provide the proper flexibility for the coating 30 on the sling. Thus, the liguid plastic is poured into the tube around the wire rope 40 so as to fill the tube to the top. At this time the tube is in a heater or oven in which the ambient temperature is 300° F. After it is filled, a pair of semicylindrical blocks 68 and 70 are slipped into the tube around the wire rope 40.

The blocks have diametrical faces 72 and 74 and each face has one-half of a vertical bore 76, 77 which fits on the rope 40, the faces 72 and 74 being in contact. At the upper ends of the blocks 68 and 70 are semicylindrical flanges 78 and 80 which rest on the top of the tube when the blocks are inserted therein. The blocks are inserted soon after the tube is filled with plastic and they move downwardly until the flanges rest on the top of the tube. The liquid lowers because it shrinks and the upper blocks tend to follow the shrinkage as they sink. The shrinkage and setting occurs during the first half-hour at the 300° F. temperature and thus it does not take very long for the blocks to come to rest at the top of the tube and also at the top of the fluid, the upper taper being formed in the conical recess. Before the plastic is poured, the interior of the tube and the blocks are lubricated so that the plastic will not adhere to them.

During this process the weight on the wire rope stretches it to hold it straight and it is centralized in the tube by the bores in the upper and lower blocks. After the first half-hour it is no longer necessary to maintain the mold in a vertical position because the plastic is set, when urethane has been used, and the tubes may be moved into a horizontal position in an oven, for example, to be further cured for another hour at 300° F. The urethane will also, after the first half-hour, cure at room temperature in 48 hours.

Typically the upper eye is formed on the sling before the molding process so as to make it easy to support the rope. After the curing process is completed, the wire rope is released by removing the clamp 62, and the rope, including the coated portion, is removed from the tube 50 and blocks.

The degreasing of the wire rope permits positive adherence of the plastic to the wire rope and embedding of the plastic around the surfaces of the outer wires and strands. This embedding adds great adhering strength to the plastic on the wire rope so that it does not come loose in operation. The second eye is formed on the wire rope after the coating has been cured and the wire rope removed from the tube.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A wire rope sling having means for protecting material lifted thereby, comprising:

a single wire rope sling having hook engaging means at both ends, a flexible, abrasion resisting coating on a substantial part of said sling intermediate the hook engaging means, said coating being fixed to and embedded between and around the outer wire rope surfaces, said coating being thick enough and hard enough to withstand the maximum load of the wire rope without damaging the load material or the coating.

2. The invention according to claim 1 in which:

said coating has a Shore hardness of approximately 95, the coating having a curved external surface.

3. The invention according to claim 1 in which:

the thickness of said coating and wire rope is approximately one and one-half inches, the diameter of said wire rope being in the range of between approximately seven-sixteenths and five-eighths inches.

4. The invention according to claim 2 in which:

the coating is urethane.

5. The invention according to claim 4 in which:

said wire rope is made of six strands of improved plow steel, nineteen wires per strand, and having an independent wire rope core.

6. The invention according to claim 1 in which:
said coating has tapered ends,
the length of the taper being about equal to the thickness of the wire rope and the coating.

7. The invention according to claim 1 in which:
said coating is one selected from the group consisting of urethane, nylon, polyvinyl chloride and teflon,
said coating having a Shore hardness of about 95 A and being sufficiently flexible to bend at least 90° carrying a maximum load for the wire rope.

8. The invention according to claim 7 in which:
said coating and sling have a diameter of one and one-half inches,
said coating being long enough on said rope so that only said coating makes contact with the material being lifted.

9. The invention according to claim 1 or 2 in which:
said coating increases the thickness of said sling about three times.

10. The method of applying a plastic coating to a wire rope sling, said coating being adapted to protect material lifted by said sling, said method comprising:
hanging a single wire rope vertically from an overhead position,
placing an elongated, open ended, walled member over a portion of the rope to be coated,
inserting a block in the lower end of said member, said block fitting snugly along the member inner wall and having a central bore to snugly receive said rope therethrough,
said block having a tapered recess in its upper end to form a taper at a lower end of the coating formed on the wire rope,
securing said member and block on said wire rope,
filling said member from its upper end with liquid plastic coating around said rope,
inserting two halves of a split block into the upper end of said member,
said upper block halves having contacting faces and a central bore formed in said faces to fit around the rope adjacent the upper end of the member, said block halves closing the upper end of the member,
said upper block halves together at their lower end forming a downwardly opening upwardly tapering recess to form a taper at the upper end of the coating,
shrinking the plastic in the member to fill all exposed spaces around the wire rope strands,
allowing said upper block halves to lower a predetermined amount in the member as the plastic shrinks, the upper block halves following the plastic downwardly, and
curing the plastic coating.

11. The method according to claim 10 including:
degreasing the rope so that the plastic will be embedded between and around the generally outer wire rope surfaces, and
lubricating the member and block surfaces so that the plastic may be easily removed therefrom.

12. The method according to claim 10 including:
curing the plastic in part while vertical by maintaining it in an ambient temperature of 300° F. for one-half hour, and
forming said upper taper during said one-half hour.

13. The method according to claim 12 including:
finishing curing the plastic for use in an ambient temperature of 300° F. for one hour.

14. The method according to claim 12 including:
finishing curing the plastic for use at room temperature for 48 hours.

15. The method according to claim 12 in which:
the plastic is urethane adapted to cure having about a 95 Shore hardness, and
finishing curing said urethane for use with the member in horizontal position in an ambient temperature of 300° F. for one hour.

16. The method according to claim 10 in which:
the plastic is one selected from the group consisting of urethane, nylon, polyvinyl chloride and teflon.

17. The method according to claim 10 in which:
said member is tubular having an inside diameter of about $1\frac{1}{2}''$ for a wire rope having a diameter in the approximate range of between 7/16" to $\frac{5}{8}''$.

18. The method according to claim 10 in which:
said member is tubular having an inside diameter of about three times the diameter of the wire rope.

* * * * *